US005103749A

United States Patent [19]

Geisselmann et al.

[11] Patent Number: 5,103,749

[45] Date of Patent: Apr. 14, 1992

[54] PROCESS AND SEWING MACHINE FOR SEWING TOGETHER LAYERS OF FABRIC ACCORDING TO A PATTERN

[75] Inventors: Heribert Geisselmann, Stutensee-Fr.; Manfred Frank, Ottersweier; Fritz Jehle, Enkenbach-Alsenborn II; Erich Willenbacher, Karlsruhe, all of Fed. Rep. of Germany

[73] Assignee: Pfaff Industriemaschinen GmbH, Kaiserslautern, Fed. Rep. of Germany

[21] Appl. No.: 623,944

[22] PCT Filed: May 26, 1989

[86] PCT No.: PCT/EP89/00589

§ 371 Date: Jul. 17, 1989

§ 102(e) Date: Jul. 17, 1989

[87] PCT Pub. No.: WO89/12126

PCT Pub. Date: Dec. 14, 1989

[30] Foreign Application Priority Data

Jun. 6, 1988 [DE] Fed. Rep. of Germany ..... 3819188

[51] Int. Cl.[5] ..... D05B 27/06; D05B 27/14

[52] U.S. Cl. ..... 112/262.3; 112/306; 112/314; 112/320; 112/153

[58] Field of Search ..... 112/306, 314, 320, 121.11, 112/153, 104, 262.3, 262.1

[56] References Cited

U.S. PATENT DOCUMENTS

| | | | |
|---|---|---|---|
| 4,757,773 | 7/1988 | Nomura et al. | 112/153 X |
| 4,982,677 | 1/1991 | Nomura et al. | 112/314 |
| 5,001,998 | 3/1991 | Suzuki et al. | 112/314 |
| 5,012,752 | 5/1991 | Murata et al. | 112/104 X |

*Primary Examiner*—Peter Nerbun

*Attorney, Agent, or Firm*—McGlew & Tuttle

[57] ABSTRACT

Patterns of two fabric layers are each recognized by a camera and the fabric layers are aligned to make these patterns agree in the transverse and longitudinal directions. According to the invention the influence of speed-related disturbance variables and pattern-related limitations during the generation of the signal is reduced. Two-dimensional images of the two fabric layers are recorded with a matrix camera each during a pause between feeds. The degree of congurence of the fabric layers according to the pattern is determined by two-dimensional cross-correlation analysis of the image points arranged in rows and columns. Aligning correction values are calculated from this degree. The edge distance of the fabric layers is determined with a section of the matrix sensors, which is a separate section in terms of evaluation. Based on the edge distance data, the lower fabric layer is adjusted to the correct distance continuously and the upper fabric layer is adjusted as needed. If slight inaccuracies are accepted and the computation operations are limited only to the areas that are of interest, the overall computation time can be considerably reduced.

7 Claims, 2 Drawing Sheets

PROCESS AND SEWING MACHINE FOR SEWING TOGETHER LAYERS OF FABRIC ACCORDING TO A PATTERN

FIELD OF THE INVENTION

The present invention pertains to a process and a sewing machine for two dimensionally aligning and sewing together two fabric layers having the same surface structure according to a pattern. The sewing machine is provided with an upper and lower feed means for varying the feed of the fabrics relative to each other by means of at least one setting device. An edge guiding device is associated with one of the two fabric layers, and first and second aligning means are provided for affecting aligning movement. At least one edge sensor is provided for determining the lateral distance between the edge adjacent to the seam to be produced in one of the fabric layers and the stitch formation site of the sewing machine. A matrix camera is provided with a surface sensor, and connected to an image memory associated with each fabric layer.

BACKGROUND OF THE INVENTION

A pattern aligning device for a sewing machine, is known from U.S. Pat. No. 4,757,773 (based on West German Offenlegungsschrift No. 3,738,893). Using the prior-art device, it is possible to sew together, according to a pattern, two fabric layers having the same surface structure or the same pattern. In the case of, e.g., a check pattern, first pattern lines of one of the fabric layers extending at right angles to the seam line are to be aligned with the corresponding pattern lines of the other fabric layer, and second pattern lines of the other fabric layer extending in parallel to the seam line are to have the same lateral distance from the seam line as the corresponding pattern lines of the other fabric layer.

As a prerequisite for aligning pattern lines extending in parallel to the seam line, one of the fabric layers first must be aligned to a predetermined edge distance from the stitch formation site. An edge sensor is provided for this purpose, which determines the distance to the edge of the fabric layer. If the actual distance value deviates from the nominal distance value, the aligning means of the corresponding edge guiding device is actuated so that the deviation between the nominal value and the actual value is eliminated. The other fabric layer is now aligned to the correct pattern by means of the other aligning means of the edge guiding device on the basis of the data obtained for a transverse mismatch that may be present by the cross-correlation analysis.

The prior-art pattern aligning device is used mainly to produce the center back seam on jackets, because perfect appearance of this seam is a very important quality criterion for the evaluation of the overall quality of these garments. It is very important here, in the case of check patterns, for the transversely extending pattern lines of the left and right parts to be perfectly aligned with each other and for the longitudinally extending pattern lines to be located at exactly the same distance from the seam line. However, because of the greater width of the jacket in the shoulder area, pattern lines that are otherwise aligned in parallel to the seam line enclose an acute angle with the seam line in this area. In the case of certain patterns, in which the distance between longitudinally extending pattern lines exceeds the width of the surface sensor, it may now occur in the shoulder area that the obliquely extending longitudinal lines move out of the field of measurement of the surface sensor, so that no longitudinal lines can be detected for a certain length of time, and consequently no signal indicating the transverse distance of the longitudinal lines can be obtained. Even though it would now be possible to use surface sensors of correspondingly large size in order to avoid this situation, such surface sensors are extremely expensive.

SUMMARY AND OBJECT OF THE INVENTION

The object of the present invention is to provide a process and a sewing machine for sewing together fabric layers according to a correct pattern. The process and sewing machine make it possible to process, in a simple manner, even patterns in which longitudinally extending pattern lines or structural elements are at relatively widely spaced locations from each other.

According to the invention, the process for two-dimensionally aligning and sewing two fabric layers together in which the fabrics have the same surface structure or pattern (plaid, checked, etc.) includes an automatic sewing machine for carrying out the process. This automatic sewing machine is provided with an upper and lower feed means which have feed travel rates which can be varied relative to one another by means of at least one setting device. An edge guiding device is provided associated with one of the two fabric layers, the edge guiding device operating at right angles to the direction of feed. First and second aligning means are provided for aligning movement of the edge guiding device. At least one edge sensor is provided for determining the lateral distance between the edge adjacent to the seam to be produced in one of the fabrics and the stitch formation site of the sewing machine. The distance value determined is compared with a presettable nominal distance value and the corresponding aligning means of the edge guiding device are actuated corresponding to the deviation. A surface sensor for each fabric layer generates a picture of each fabric's surface. A signal processing device is provided which generates digital image data for each fabric from the picture elements or pixels of the surface. These picture elements are arranged in rows and columns and the signal processing device determines the displacement of structural elements for the two fabrics by two-dimensional cross-correlation analysis of the digital image data of the two fabrics shifted row by row and column by column. The signal processing device actuates the adjusting device as a function of the values of the longitudinal displacement and the other aligning means of the edge guiding device as a function of the value of the transverse displacement. The processing unit assists in determining the lateral distance between the edge adjacent to the seam to be produced and the stitch formation site of the sewing machine for each of the two fabrics. If the structural elements (pattern elements) extending longitudinally are temporarily not recognized, the alignment of the fabric layer according to the pattern at right angles to the direction of feed is interrupted and the edge of this layer is then adjusted. During this adjustment process, the previous distance between the edge of this fabric layer and the stitch formation site of the sewing machine, which existed prior to the change from pattern alignment to edge related alignment, is used as the nominal distance value. A matrix camera with a surface sensor is employed wherein the camera is connected to an image memory associated with each fabric.

An edge scanning sensor is provided for determining each of the lateral distance between the edge of each of the two fabrics, the edge being adjacent to the seam to be produced, and the stitch formation site.

In order to rapidly determine whether longitudinally extending pattern lines or structural elements can be recognized by the surface sensors, a computation operation, which is to be performed after each displacement of the mask image, is simplified in which in order to rapidly determine whether longitudinally extending structural elements are recognizable. A simplified standardized cross-correlation analysis is used for the-dimensional cross-correlation analysis. The mean value of the entire search image and using the result in each computational shifting step and by multiplying prior to each displacement the digital image data of the individual picture elements of the search image of the mask image, which image data corresponds to each other, prior to each displacement and after each row by row and column by column displacement of the mask image, the products obtained are added to obtain cross-correlation sums from which the maximum is calculated and the cross-correlation co-efficient determining the quality of this maximum is calculated from this maximum for increasing the accuracy of the determination of the geometric location in the case of a cross-correlation function scanned relatively roughly, by making uniform a calculated magnitude that is to be computed anew each time, and the time-consuming, exact computation method needed to accurately determine the degree of coverage of the two fabric layers is limited to the image area that is currently of interest, as a result of which the overall computation time needed for the cross-correlation analysis is considerably reduced.

The parabolic approximation method makes it possible to determine the possible mutual mismatch of the two fabrics with very high accuracy even in the case of relatively large image points or pixels.

The reduction of the overall computation time for the cross-correlation analysis not only makes it possible to rapidly determine whether longitudinally extending pattern lines are recognizable and can be used for the transverse displacement of the fabric layers to be sewn together, but it also leads to an increase in the speed of sewing, while a possible pattern mismatch is still determined and corrected accurately.

The design of the sewing machine is especially advantageous given the ability in which the edge scanning sensor is part of the surface sensor of the corresponding matrix camera. Thus it becomes unnecessary to use a separate sensor for edge scanning.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
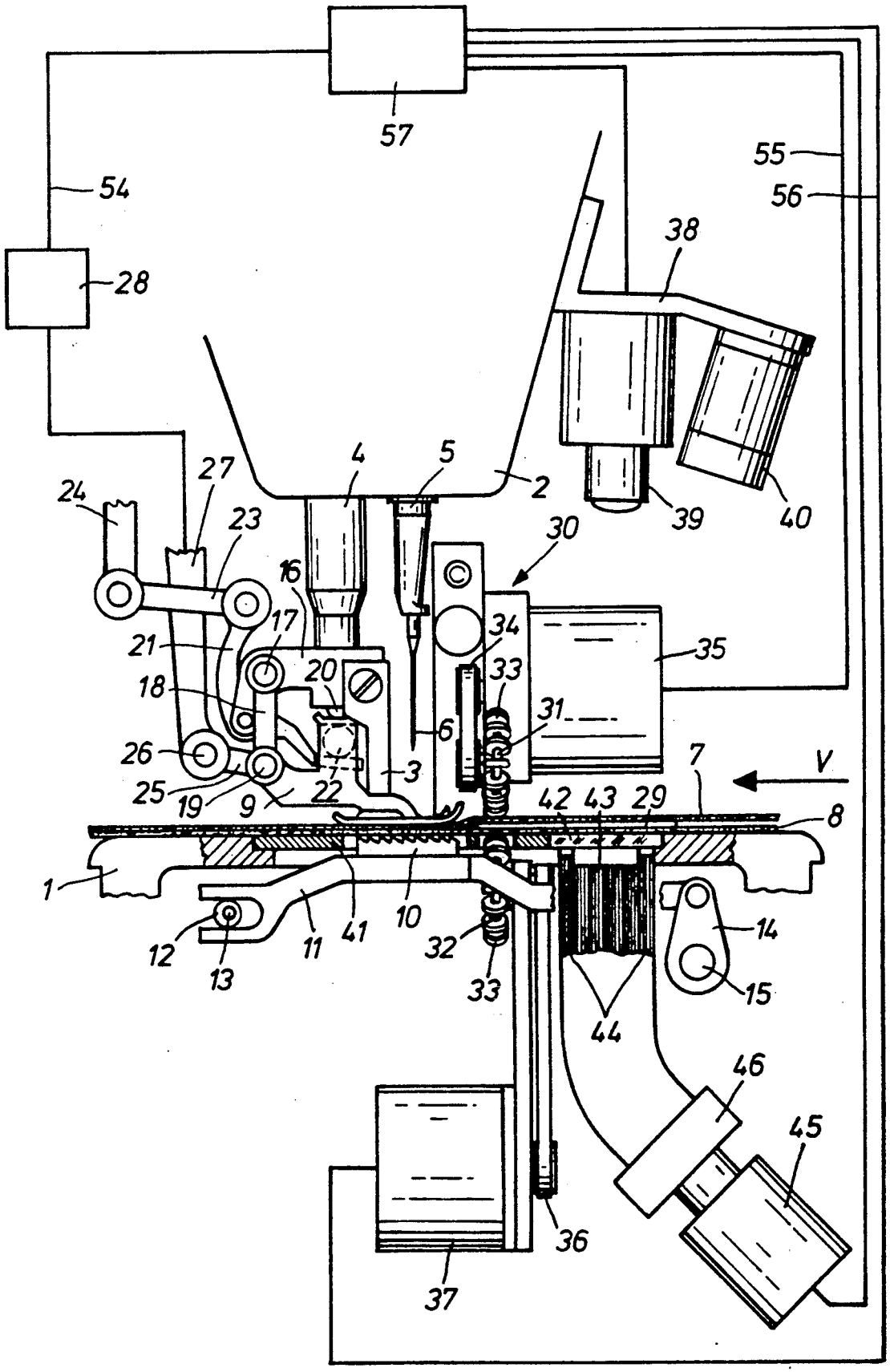
FIG. 1 is a side view of a sewing machine with two matrix cameras according to the invention.

The sewing machine, which is shown only partially in FIG. 1, has a base plate 1 and a head 2. The presser foot bar 4 carrying an ordinary presser foot 3, and the needle bar 5, whose thread-carrying needle 6 cooperates with a shuttle (not shown), are housed in the head 2. To feed two fabrics 7 and 8 that are to be attached to each other, the sewing machine has an upper feed dog 9 and a lower feed dog 10.

The lower feed dog 10 is received by a support 11, whose fork-shaped end straddles an eccentric 12 that is arranged on a shaft 13 mounted in the base plate 1 and imparts a lifting movement to the feed dog 10 during each stitch formation process. The other end of the support 11 is connected to a crank 14, which is fastened to a shaft 15 that is also mounted in the base plate 1.

Figure 3:
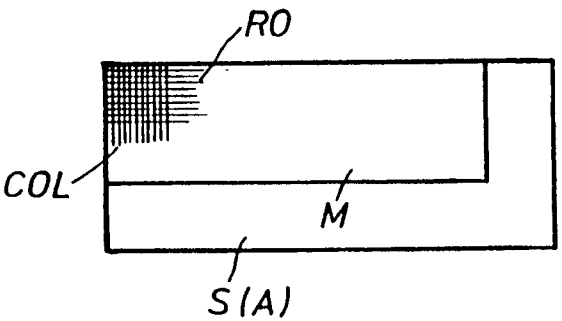
FIG. 3 is a representation of an image format of an image and a mask image according to the invention.

The shaft 15 is driven by an adjustable drive mechanism (not shown), which is designed, like the drive mechanism represented in FIG. 3 for the shaft 15 of U.S. Pat. No. 4,612,867 (based on West German Patent No. 3,346,163), which is also designated by reference numeral 15, and functions in the same way.

The lower end of the presser foot bar 4 is provided with a transverse web 16 carrying a pin 17. A connecting rod 18, which is hinged to the upper feed dog 9 by means of a pivot pin 19, is mounted on the pin 17. This upper feed dog is being steadily pressed downward by a spring-tensioned ball 20 and receives its lifting movement from a lever 21 mounted pivotably on the transverse web 16, and the free end of the lever 21 extends under a roller 22 carried by two lateral support webs of the upper feed dog 9. The other end of the lever 21 is connected to an angle lever 24 via an intermediate member 23.

The angle lever 24 is connected to a cam drive (not shown), which corresponds to the cam drive shown in FIG. 3 of U.S. Pat. No. 4,612,867 (based on West German Patent No. 33,46,163), which is intended to drive the angle lever designated by reference numeral 48 there and serves to lift the upper feed dog 9 in cadence with the stitch formation.

To drive the upper feed dog 9, an intermediate rod 25, which is connected by a pivot pin 26 to a swivel arm 27, acts on the pin 19. The swivel arm 27 is connected to a drive mechanism (not shown), which is designed as the drive mechanism shown in FIG. 3 of U.S. Pat. No. 4,612,867 for the swivel arm designated by reference numeral 58 there and functions in the same manner.

To change the amount of feed of the top feed dog 9 relative to the amount of feed of the lower feed dog 10, a schematically represented adjusting device 28 is provided, which is designed as the adjusting device 80 in West German Patent No. DE-PS 33,46,163 and consequently contains, among other things, a stepping motor that is not shown here.

To guide the edges of the two fabrics 7 and 8 separated from each other by a separating plate 29, an edge guiding device 30, which corresponds to the guiding device disclosed in U.S. Pat. No. 4,681,051 (based on West German Utility Patent No. DE-GM 85,16,184) and designated by reference numeral 6 there, is arranged in front of the presser foot 3. Thus, the edge guiding device 30 has an upper guide wheel 31 and a lower guide wheel 32. Both guide wheels 31, 32 carry on the circumferential sides of their wheel bodies a plurality of freely rotatable rollers 33 arranged at right angles to the plane of the wheel. The upper guide wheel 31 is connected via a toothed belt drive 34 to a stepping motor 35. The lower guide wheel 32 is in a drive connection with a stepping motor 37 via a toothed belt drive 36.

A CCD matrix camera 39 and an illuminating device 40 are arranged on a support 38 fastened to the front side of the head 2.

A fiber-optic light guide bundle 43, which is surrounded by a fiber-optic light guide bundle 44 and separated from it, is arranged under and at a spaced location from a glass plate 42 inserted in the needle plate 41 in front of the stitch formation site. The inner fiber-optic light guide bundle 43 is connected to a CCD matrix camera 45 and the outer fiber-optic light guide bundle 44 is connected to an annular illuminating device 46. An optical system, which permits selective illumination of the measuring surface and images the measuring surface on the front side of the inner fiber-optic light guide bundle 43, is arranged under the glass plate 42.

Figure 2:
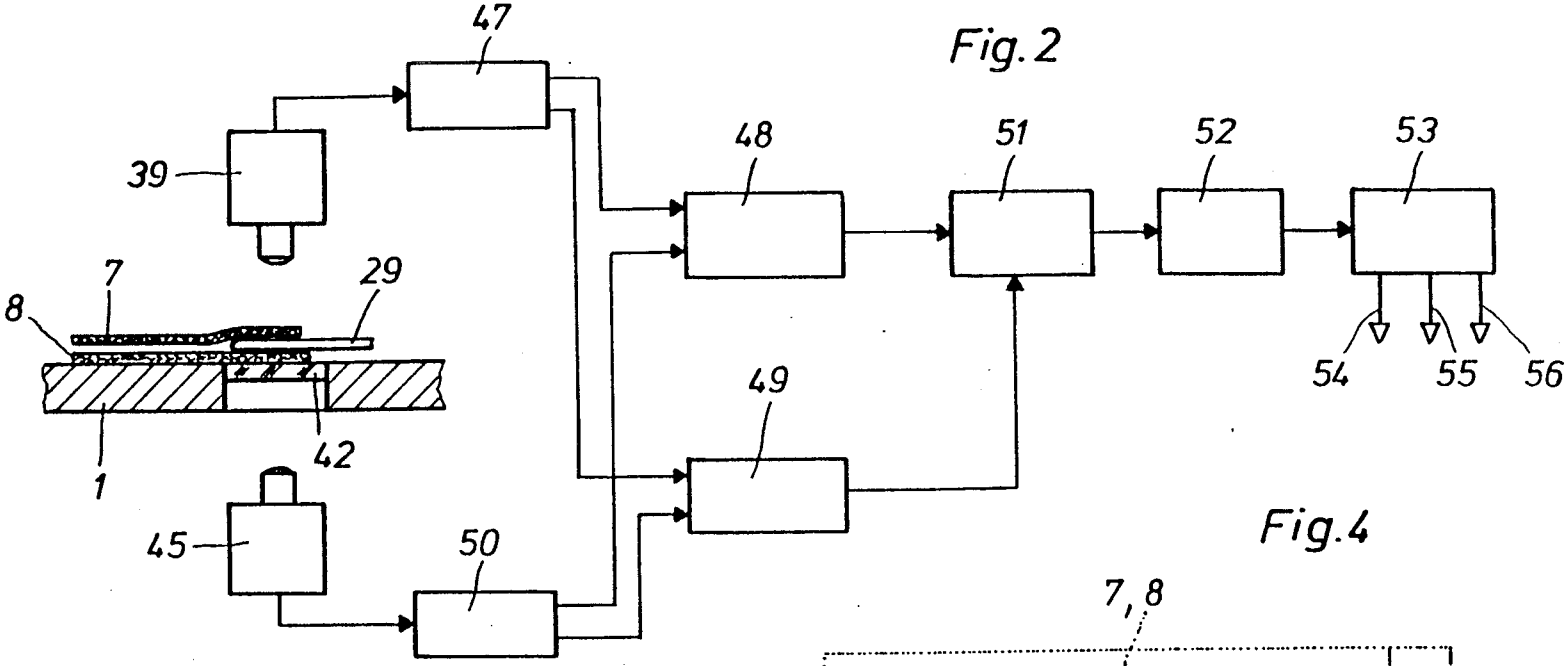
FIG. 2 is a block diagram of a signal processing device according to the invention.

The matrix camera 39 is connected to an image memory 47 (FIG. 2) for receiving digital image data. In terms of addresses, the image memory 47 is subdivided into two segments of different size, of which the larger one is connected to a correlation module 48 and the smaller one to an edge evaluation module 49. The matrix camera 45 is connected to an image memory 50 for receiving digital image data. Like the image memory 47, the image memory 50 is subdivided, in terms of the addresses, into two segments of different size, of which the larger one is connected to the correlation module 48 and the smaller one to the edge evaluation module 49.

The correlation module 48 and the edge evaluation module 49 are connected to a mismatch correction module 51. A control module 52, which is connected via a stepping motor control circuit 53 and appropriate lines 54, 55, 56 to the stepping motor (not shown) of the adjusting device 28 and the two stepping motors 35, 37 of the edge guiding device 30, is connected to the mismatch correction module 51. The image memories 47, 50, the modules 48, 49, 51 and 52, as well as the control circuit 53 form a signal processing device 57.

MODE OF OPERATION

Figure 4:
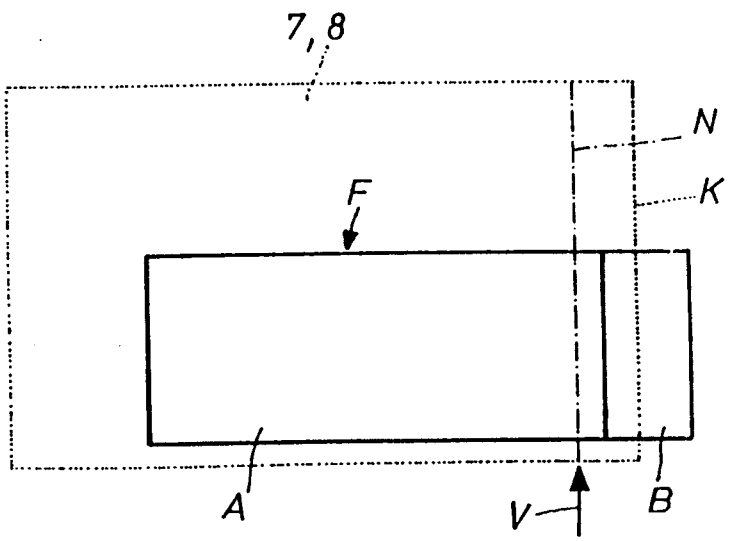
FIG. 4 is a representation, according to the invention, of a position of an entire image field consisting of an area for structure comparison and an area for edge measurement relative to the associated fabric layer.

The size of the image field F on the actual fabric 7 or 8, which can be detected by the matrix cameras 39, 45, equals approximately 45×15 mm, and this surface area corresponds to a matrix field of 104 columns×32 rows, corresponding to a total of 3328 image points or pixels, each image point being of 0.44×0.44 mm. According to FIG. 4, the two image fields F are subdivided into two functionally different areas. The pattern mismatch of the two fabrics 7 and 8 at right angles to and in parallel to the direction of feed V is determined in a section A consisting of 85 columns COL and 32 rows RO, see FIG. 3. The position of the edge K, of the corresponding fabric 7 or 8, adjacent to the seam S to be prepared, relative to the needle 6, is determined in a section B consisting of 19 columns and likewise 32 rows.

Charge carriers, whose number corresponds to the brightness of the image in the individual image points, are released in a known manner by the incident photons in the individual cells of the CCD sensors. These cells are associated with one image point of the image fields F. The charge carriers are each converted, also in a known manner, into one byte of digital image data in a circuit part of each camera. The brightness of each image point being represented by a numerical value between 0 and 255.

To recognize the pattern mismatch of the two fabrics 7 and 8, the image of the lower matrix camera 45, which is called the mask image M, is displaced row by row and column by column over the image of the upper matrix chamber 39, which image is called the search image S. In order to keep the mask image M from extending beyond the edge of the search image S, the mask image M is selected to be smaller than the search image S corresponding to section A in proportion to the range of displacement.

The range of displacement depends on the maximum permissible pattern mismatch prior to the pattern alignment. If the permissible pattern mismatch is ±1.5 mm, the range of displacement equals 10 image points in the longitudinal and transverse directions. Since 11 different states of congruence (starting position +10 displacements) are obtained during each displacement by 10 image points in each direction of displacement, and since interpolation performed between the function values in order to increase the accuracy, causes the field to be expanded by one function value at each boundary, thus a field of 13×13 function values is ultimately obtained. The mask image M is consequently selected to be smaller than the search image S by 12 image points in the directions of both the rows and the columns.

The similarity of two functions describing the pattern or surface structures of the two fabric layers 7, 8 can be exactly calculated by the two-dimensional standardized cross-correlation function KKF.

The KKF coefficient (p) is calculated as follows:

$$p = \frac{\Sigma_i \Sigma_j (S_{ij} - S)^* (M_{ij} - M)}{(\Sigma_i \Sigma_j (S_{ij} - S)^2 * \Sigma_i \Sigma_j (M_{ij} - M)^2)^{\frac{1}{2}}}$$

p = cross-correlation coefficient, range (−1, . . . ,+1)

$S_{ij}$ = gray scale value of one image point of image 1 (search image)

$M_{ij}$ = gray scale value of one image point of image 2 (mask image)

$\bar{S}$ = mean value for the search image detail $\bar{M}$ = mean value of the mask image ij = row and column variables in image coordinates.

The KKF coefficient is an indicator of the similarity of the functions compared and has a value in the range of (−1 , . . . ,+1). Here, p = +1: closest possible similarity p = 0: no similarity p = −1: greatest possible "inverse" similarity.

In the case of a standardized procedure, the KKF coefficient is calculated for each possible mismatch within the range of mismatch. A two-dimensional function with the two orthogonal displacement values as the variables is thus obtained. This function has a maximum in the position of the greatest agreement between the two images. The value of the maximum is an indicator of the degree of similarity.

If the standardized KKF is used, the following terms are to be computed for accurate computation after each displacement:

$$S = \frac{\Sigma_i^{73} \Sigma_j^{20} S_{ij}}{73*20} \quad (1)$$

$$M = \frac{\Sigma_i^{73} \Sigma_j^{20} M_{ij}}{73*20} \quad (2)$$

$$\Sigma_i^{73} \Sigma_j^{20} (S_{ij} - S)*(M_{ij} - M) \quad (3)$$

$$\Sigma_i^{73} \Sigma_j^{20} (S_{ij} - S)^2 \quad (4)$$

$$\Sigma_i^{73} \Sigma_j^{20} (M_{ij} - M)^2 \quad (5)$$

$13 \times 13 = 169$ KKF coefficients are to be determined to evaluate an entire image pair. Since the gray scale value Sij of the image points of the search image S is multiplied by the gray scale value Mij of the image points of the mask image M row by row and column by column, and the above-mentioned terms are also to be computed to calculate every KKF coefficient, there are more than 700,000 computation operations for the KKF analysis of each entire image pair. If a computer with a speed of 20 MHz is used, the computation time will be approximately 37 msec. The total time will be over 50 msec, because approximately 5 msec for the actual recording and data transmission from the camera to the evaluation system and approximately 10 msec for the computation of the correcting variables must be added to the computation time proper. Such a relatively long time is acceptable in the case of low-speed sewing machines.

However, the computation time must be substantially reduced if sewing machines with a speed of 6000 rpm are used. To achieve this, a slight reduction of accuracy is accepted by not computing term 1 for each search image detail in which the pattern comparison is performed. Instead, the mean value of the entire search image (S) is determined only once, and the result is used for each displacement step.

To further reduce the computation time, terms 4 and 5 are computed only for the displacements during which the KKF reaches maxima, because the quality of these maxima is of interest only in this alignment of the patterns. A nonstandardized maxima, is formed after each displacement of the mask image M by computing only the numerator in the equation for determining the KKF coefficient. The sums are then sorted according to value, as a result of which their nonstandardized maxima are determined. Since the sums lead to high values in the case of light-colored fabrics or pattern sections and to low values in the case of dark fabrics or pattern sections, the maxima of the sums do not yet provide any information on the actual similarity of the functions or the actual position of a pattern mismatch. After computation of the standardized KKF coefficients for the function maximum, the degree of similarity of the two fabric patterns is known, and it is possible to make a decision on whether the measured value will be used to correct the mismatch. However, since the time-consuming computation is used only for one pronounced maximum or a few prominent maxima, this method makes it possible to reduce the computation time to approximately one third. The simplified two-dimensional KKF analysis can thus be applied even to high-speed sewing machines with a speed of 6000 rpm if one image is recorded by the matrix camera 39, 45 during every third feed pause of the fabric layers 7, 8.

To accurately determine the geometric position of the closest similarity, a parabolic approximation method is applied row by row as well as column by column, using the KKF sums adjacent to the maximum of the KKF sums, and the exact position of the closest similarity is obtained from the pedal point of the parabolas now calculated.

The geometric position of the closest similarity of the KKF is also an indicator of the mutual mismatch of the pattern or surface structure of the two fabrics 7 and 8, which mismatch may be present at right angles to the direction of feed and in the latter direction. This indicator is transmitted from the correlation module 48 into the mismatch correction module 51.

The gray scale value difference between the fabrics 7 and 8, and the separating plate 29 is determined for the sections B of the image fields F, by evaluating the sums of the image columns COL extending in parallel to the direction of feed V are evaluated. Because the geometric position of the image columns COL is unambiguously defined, the instantaneous position of the edge K of each fabric 7 and 8 can be easily recognized from the number of the non-covered image columns COL. The distance between the edges K and the needle 6, which is thus determined, is also fed into the mismatch correction module 51 from the edge evaluation module 49.

The pattern mismatch data and the edge distance data are subsequently processed in the mismatch correction module 51, in order to generate correction data for maintaining a predetermined edge distance of the lower fabric layer 8 and eliminating a pattern mismatch that may exist between the two fabrics 7 and 8. The correction data is subsequently processed in the control module 52 and the stepping motor control circuit 53 into control data for the stepping motors 35, 37 and the stepping motor (not shown) of the adjusting device 28. While the edges of the lower fabric layer 8 are aligned by the stepping motor 37 and the guide wheel 32, the alignment of the upper fabric layer 7 according to the pattern relative to the lower fabric layer 8 is performed by the adjusting device 28 and the upper feed dog 9 in the direction of feed V and by the stepping motor 35 as well as the guide wheel 31 at right angles to the direction of feed V.

As long as the matrix cameras 39, 45 recognize structures or pattern lines extending in the direction of feed, the edge distance of the upper fabric 7 remains irrelevant for the alignment of the upper fabric 7, because this is aligned relative to the lower fabric 8 both at right angles and in parallel to the direction of feed V on the basis of the correction data obtained during the KKF analysis. It can now happen that in the case of agreement of the pattern with the lower fabric 8, the upper fabric 7 has a different edge distance than the lower fabric 8 that has been adjusted to a predetermined edge distance.

If structures or pattern lines extending in the direction of feed (V) are temporarily not recognized, the edge distance of the upper fabric 7, which was formed at the time of the latest pattern adjustment, serves as the nominal value for the edge distance control of the upper fabric layer, which is performed until structures or pattern lines extending in the direction of feed (V) are again recognized at the next time.

Because the amount of mismatch at the time of the next recording by the matrix cameras 39, 45 is actually reduced rather than increased due to the aligning movements performed after the first KKF analysis to reduce an existing pattern mismatch, a further reduction of the computation time can be achieved if the previous data from the preceding KKF analysis are taken into account by limiting the computation operations to determine the KKF sums to the range immediately adjacent to the previously calculated mismatch value.

While a specific embodiment of the invention has been shown and described in detail to illustrate the application of the principles of the invention, it will be understood that the invention may be embodied otherwise without departing from such principles.

We claim:

1. A process for two-dimensionally aligning and sewing together, two fabric layers having the same surface structure with a sewing machine and an edge guiding device, comprising the steps of:

performing feeding movements of the fabric layers employing an upper and a lower feeding means and changing the extent of feed of the feeding means relative to one another by employing adjusting means;

performing an alignment, at right angles to a direction of feed, with a first aligning means for one of the fabric layers and with a second aligning means for the other fabric layer;

determining a lateral distance between an edge adjacent to the seam to be produced of one fabric layer and the stitch formation site of the sewing machine by employing at least one edge sensor;

comparing said lateral distance value determined by said edge sensor to a pre-settable nominal distance value and actuating said first and second aligning means of the edge guiding device compensating for a deviation between said lateral distance value and said nominal distance value;

employing one surface sensor for fabric generating picture elements of the fabric layers, said picture elements of one fabric forming a mask image and said picture elements of the other fabric forming a search image, said picture elements being arranged in rows and columns;

employing a signal processing unit for generating digital image data for each fabric from said picture elements of flat sections of the surface thereof;

determining displacement of identical structural pattern elements of the two fabric layers, in parallel and at right angles to the direction of feed, by two-dimensional cross-correlation analysis of said digital image data of said search image and of said mask image which is shifted row by row and column by column;

actuating the adjusting means as a function of the amount of said parallel displacement and actuating said aligning means of said edge guiding device as a function of the amount of said right angle displacement;

determining the lateral distance between the edge adjacent to the seam to be produced and the stitch formation site of the sewing machine for each of the two fabric layers;

determining if structural pattern elements extending longitudinally are temporarily not recognized and if said structural elements extending longitudinally are temporarily not recognized, interrupting the alignment of a particular fabric layer whose edge has not since been aligned according to the pattern at right angles to the direction of feed and adjusting the edge of said particular fabric layer in a subsequent adjustment step; and during said subsequent adjustment step, using as a nominal distance value the distance between the edge of said particular fabric layer and the stitch formation site of the sewing machine which existed prior to the change from the alignment according to the pattern of the edge-related alignment.

2. Process according to claim 1, wherein: in order to rapidly determine whether longitudinally extending structural elements are recognizable, a simplified standardized cross-correlation analysis is employed by determining the means value(s) of the entire search image and using the result in each computational shifting step.

3. A process according to claim 2, wherein:

said digital image data of said individual of said search image and said mask image, which correspond to each other are multiplied row by row and column by column in displacements of said mask image and then adding the products obtained to provide cross-correlation sums, from which a maximum is calculated and the cross-correlation coefficient determining the quality of the maximum is calculated from the determined maximum.

4. A process according to claim 2, wherein:

the accuracy of the determination of the geometric location of the maximum is increased by parabolic approximation in the case of a cross-correlation function scanned relatively roughly.

5. A sewing machine for two-dimensionally aligning and sewing together two fabrics having the same surface structure according to a pattern, the sewing machine comprising:

upper and lower feed means, whose feed travels can be varied relative to one another by means of at least one adjusting means;

an edge guiding device associated with one of the two fabrics which operates at right angles to the direction of feed and whose aligning movement can be performed by first and second aligning means;

at least one edge sensor for determining the lateral distance between the edge adjacent to the seam to be produced in one of the fabric layers and the stitch formation site of the sewing machine, wherein the distance value determined is compared with a presettable nominal distance value, and the corresponding aligning means of the edge guiding device are actuated corresponding to the deviation;

one surface sensor for each fabric producing a mask image for one fabric and a search image for the other fabric;

a signal processing device which generates digital image data from said surface sensor for each fabric layer, said digital image data being made of picture elements of flat sections of the surface, said picture elements being arranged in rows and columns;

said signal processing device also determines the mutual displacement of structural elements of the fabric layers by two-dimensional cross-correlation analysis of the digital image data of the search image and of the mask image shifted row by row and column by column, and actuates the adjusting means as a function of the value of the parallel displacement and actuates said first and second aligning means of the edge guiding device as a function of the value of the lateral distance between the edge adjacent to the seam to be produced and the stitch formation site for each of the two fabric layers, such that at a time when longitudinally extending structural elements are temporarily not recognized, the alignment of a particular fabric layer having an edge which has not since been aligned according to the structural elements at right angles to the direction of feed, is interrupted, after which the edge of said particular fabric layer is also adjusted, and the distance between the edge of said particular fabric layer and the stitch formation site of the sewing machine, which existed prior to the change from the pattern-oriented alignment to the edge-related alignment, is used as the nominal distance value;

matrix camera means including a surface sensor, said matrix camera means being connected to an image memory associated with each fabric layer, one edge scanning sensor being provided for each fabric layer to determine the lateral distance between the edge of each of the two fabric layers, which edge is adjacent the seam to be produced, and the stitch formation site.

6. A sewing machine according to claim 5, wherein said edge scanning sensors are part of said surface sensor of said matrix camera.

7. A sewing machine for two-dimensionally aligning and sewing together two fabrics having the same surface structure according to a pattern, the sewing machine comprising:

upper and lower feed means, whose feed can be varied relative to each other;

edge guiding means for moving one of the fabrics at right angles to said feed;

upper surface sensing means for creating upper picture elements of the upper fabric of the two fabrics, said upper picture elements being aligned in rows and columns;

lower surface sensing mans for creating lower picture elements of the lower fabric of the two fabrics, and lower picture elements being aligned in rows and columns; and signal processing means receiving said upper and lower picture elements and performing a two-dimensional cross-correlation analysis on said upper and lower picture elements, said two-dimensional cross-correlation analysis determining an alignment of the two fabrics, and said signal processing mans controlling said upper and lower feed means, and said edge guiding means, to perform said alignment determined by said two-dimensional cross-correlation analysis, said signal processing means also determining if the surface structure is recognizable, such that if said surface structure is not recognizable, then said processing means interrupts said two-dimensional cross-correlation analysis until the surface structure is recognizable, said signal processing means using previous alignment values for said alignment of the two fabrics at a time when the surface structure is determined to be unrecognizable, said previous alignment values being determined from said two-dimensional cross-correlation analysis performed previous to the time when said surface structure is determined to be unrecognized.

* * * * *